US010914074B2

(12) United States Patent
Williams

(10) Patent No.: US 10,914,074 B2
(45) Date of Patent: Feb. 9, 2021

(54) RAIN GUTTER INSTALLATION DEVICE

(71) Applicant: Bartley R. Williams, Voorhees, NJ (US)

(72) Inventor: Bartley R. Williams, Voorhees, NJ (US)

( * ) Notice: Subject to any disclaimer, the term of this patent is extended or adjusted under 35 U.S.C. 154(b) by 0 days.

(21) Appl. No.: 16/431,953

(22) Filed: Jun. 5, 2019

(65) Prior Publication Data

US 2019/0376294 A1 Dec. 12, 2019

Related U.S. Application Data

(60) Provisional application No. 62/683,092, filed on Jun. 11, 2018.

(51) Int. Cl.
*E04D 13/064* (2006.01)
*E04D 13/072* (2006.01)
*E04D 15/00* (2006.01)

(52) U.S. Cl.
CPC ..... *E04D 13/0722* (2013.01); *E04D 15/00* (2013.01)

(58) Field of Classification Search
CPC ..... E04D 13/064; E04D 13/068; E04D 2013/0846; H02G 3/0608
See application file for complete search history.

(56) References Cited

U.S. PATENT DOCUMENTS 186,529 A * 1/1877 Biegelaar ..... E04D 13/068 405/121
230,396 A * 7/1880 Bonbrak ..... E04D 13/068 405/121
453,989 A * 6/1891 Wock ..... E04D 13/068 405/121
497,466 A * 5/1893 Davidson ..... E04D 13/068 405/122
1,087,791 A * 2/1914 Leavitt ..... E04D 13/068 405/122
1,317,943 A * 10/1919 Robertson ..... E04D 13/068 405/121
1,682,840 A * 9/1928 Foerch, Jr. ..... E04D 13/068 405/122
RE24,245 E * 12/1956 Ager ..... E04D 13/064 52/15
2,821,154 A * 1/1958 Tennison, Jr. ..... E04D 13/068 405/122
3,156,099 A * 11/1964 Dailey ..... E02B 13/00 405/121
3,611,731 A * 10/1971 Redmondson ..... E04D 13/064 405/120

(Continued)

*Primary Examiner* — Gisele D Ford
(74) *Attorney, Agent, or Firm* — Kim IP Law Group LLC

(57) ABSTRACT

A rain gutter installation device including an expandable rain gutter support and hoist member. The device is constructed to have a transverse cross-sectional area sufficiently large enough to accommodate the sizes and shapes of conventional gutters. The device can include at least one first trough and at least one second trough movable relative to the first trough. The device may expand from about 6 to about 20 feet in length, whereby a considerable length of gutter may be supported in the desired mounting orientation and the likelihood of excessive twisting of the ends of the gutter during hoisting is minimized. As a result, a single installer can install gutter lengths of up to about 60 feet without the assistance of one or more additional installers.

3 Claims, 5 Drawing Sheets

(56) References Cited

U.S. PATENT DOCUMENTS

| | | | | | |
|---|---|---|---|---|---|
| 3,670,505 | A * | 6/1972 | Weaver | E04D 13/068 | 405/121 |
| 3,913,284 | A * | 10/1975 | Hall | E04D 13/0645 | 52/11 |
| 4,257,716 | A * | 3/1981 | Woodrow | E04D 13/0641 | 405/118 |
| 5,038,528 | A * | 8/1991 | Brant | E04D 13/068 | 248/48.1 |
| 5,216,852 | A * | 6/1993 | Bemis | E04D 13/064 | 248/48.1 |
| 5,435,105 | A * | 7/1995 | Visser | E04D 13/064 | 52/12 |
| 6,143,984 | A * | 11/2000 | Auteri | H02G 3/0608 | 174/101 |
| 6,202,357 | B1 * | 3/2001 | Spradlin | E04D 13/076 | 52/12 |
| 6,634,605 | B2 * | 10/2003 | Bernard | H02G 3/0608 | 248/68.1 |
| 9,963,881 | B1 * | 5/2018 | Aleman | E04D 13/068 | |
| 2001/0030052 | A1 * | 10/2001 | Ewer | H02G 3/0608 | 174/502 |
| 2001/0032418 | A1 * | 10/2001 | Richardson | E04D 13/064 | 52/11 |
| 2005/0016076 | A1 * | 1/2005 | Spradlin | E04D 13/0641 | 52/11 |
| 2008/0199251 | A1 * | 8/2008 | Beck | H02G 3/0608 | 403/293 |
| 2015/0260935 | A1 * | 9/2015 | Williams | F21V 33/006 | 362/217.14 |

* cited by examiner

RAIN GUTTER INSTALLATION DEVICE

CROSS-REFERENCE TO RELATED APPLICATION

This application claims priority under 35 U.S.C. § 119(e) to U.S. Provisional Application Ser. No. 62/683,092, filed Jun. 11, 2018, and entitled "Rain Gutter Installation Device," the disclosure of which is hereby incorporated by reference in its entirety for all purposes.

FIELD OF THE DISCLOSURE

The present disclosure is generally directed to a rain gutter installation device. In particular, the present disclosure is directed to a rain gutter installation device comprising an expandable rain gutter support and hoist member for enabling a single worker to install a rain gutter of considerable length on a building without the assistance of another worker.

BACKGROUND OF THE DISCLOSURE

Residential rain gutter run lengths may run as long as approximately 60 feet. Many installers cannot install a rain gutter (hereinafter, "gutter") of more than about 45 feet in length without the assistance of another worker. A typical installer's arm span is about six feet. Consequently, the typical installer can only support approximately the centermost six feet of a gutter, which may extend 45 feet or more in length. As a consequence, when a single installer lifts a lengthy gutter into position for mounting on a building, the opposite ends of the gutter tend to twist out of position, thereby rendering them difficult to mount to the building or, worse, possibly causing folds or creases to form in the gutter that must be repaired before the gutter can be mounted. Presently, the only reliable way of preventing twisting of a long run of gutter is to have two installers supporting the gutter whereby the gutter can be maintained substantially straight for mounting. As can be appreciated, the inclusion of a second installer is labor and cost intensive.

Thus, there is a need for a rain gutter installation device capable of enabling a single installer to install long runs of gutter without the assistance of one or more additional installers. This need is satisfied by the rain gutter installation device of the present disclosure.

SUMMARY OF THE INVENTION

The present disclosure provides a rain gutter installation device comprising a trough assembly having an opening sufficient to receive a rain gutter therein. The trough assembly can include a first trough and a second trough engaged with and extendable from the first trough. In one embodiment, the trough assembly may expand from about 6 to about 20 feet in length or more, whereby a considerable length of gutter may be supported in the desired mounting orientation and the likelihood of excessive twisting of the ends of the gutter is minimized. As a result, a single installer can install gutter lengths of up to about 60 feet without the assistance of one or more additional installers.

Other features and advantages of the present disclosure will be apparent from the following more detailed description of the embodiments.

BRIEF DESCRIPTION OF THE SEVERAL VIEWS OF THE DRAWINGS

The foregoing, as well as the following detailed description of the invention, will be better understood when read in conjunction with the appended drawings. The embodiments shown in the drawings are for the purpose of illustrating the present invention. It should be understood, however, that the present disclosure is not limited to the precise arrangements and instrumentalities shown.

In the drawings.

DETAILED DESCRIPTION OF THE DRAWINGS

Figure 1:
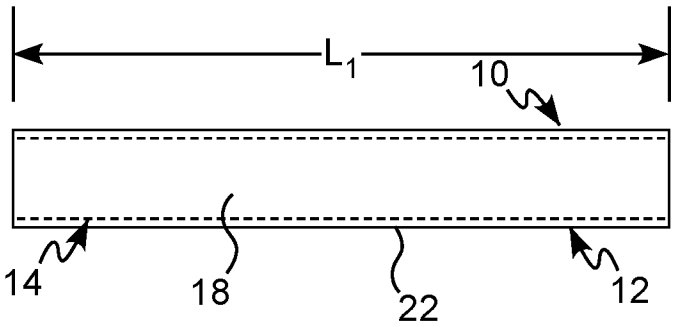
FIG. 1 is a side elevation view of a rain gutter installation device in accordance with an embodiment of the present disclosure in unexpanded condition.

Reference will now be made in detail to the embodiments of the present disclosure illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

"About," as used herein when referring to a measurable value, such as an amount, a temporal duration, and the like, is meant to encompass variations of ±20%, ±10%, ±5%, ±1%, and ±0.1% from the specified value, as such variations are appropriate.

"Substantially," as used herein, shall mean considerable in extent, largely, but not wholly, that which is specified, or an appropriate variation therefrom as is acceptable within the field of art.

Throughout the present disclosure, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range, such as from 1 to 6, should be considered to have specifically disclosed subranges, such as from 1 to 3, from 1 to 4, from 1 to 5, from 2 to 4, from 2 to 6, and from 3 to 6, etc., as well as individual numbers within that range, for example, 1, 2, 2.7, 3, 4, 5, 5.3, and 6. This applies regardless of the breadth of the range.

Referring now to the figures, FIGS. 1, 2, 3A and 4 depict a first embodiment of a rain gutter installation device 10 in accordance with the present disclosure. The rain gutter installation device comprises trough assembly having an opening sufficient to receive a rain gutter therein. The trough assembly can include a first trough 12 and a second trough 14 engaged with and extendable from the first trough, whereby the second trough is telescopically engaged with the first trough. Although shown as comprising first and second telescopic troughs, device 10 may also include three or more telescopic troughs, as will be described in connection with FIG. 3B.

As shown in FIGS. 1, 2, 3A and 4, first trough 12 can comprise a first upright wall 18 and an opposed second upright wall 20 extending substantially parallel to the first wall 18. A bottom wall 22 extends between the first and second upright walls 18, 20. Depending from top edges of the first and second upright walls 18, 20, respectively, of the first trough 12 are first and second downwardly directed retaining members 30 and 32. The retaining members 30, 32 of the first trough 12 may extend downwardly about ¾ to about ½ inches from the top of the first and second upright walls 18, 20. According to an embodiment of the present disclosure, the length $L_1$ of the first trough 12 may have a length of about 6, 7, 8, 9, or 10 feet.

Figure 5:
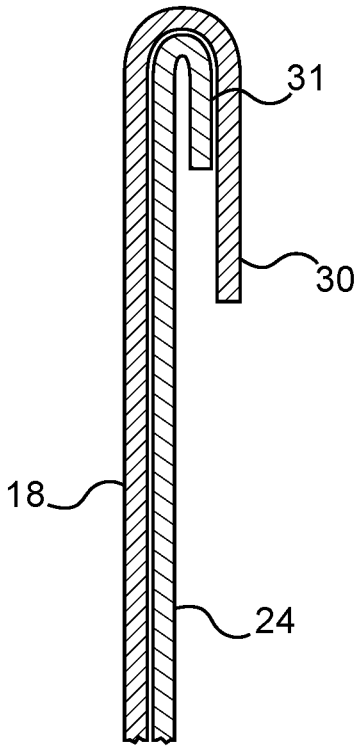
FIG. 5 is an enlarged partial elevational view of an upright wall of a second trough received within an upright wall of the first trough of the rain gutter installation device of FIG. 1

Second trough 14 can comprise a first upright wall 24 and an opposed second upright wall 26 extending substantially parallel to the first wall 24, as well as a bottom wall 28 extending between the first and second upright walls 24, 26. The retaining members 30, 32 of the first trough 12 enclose the top edges of the first and second upright walls 24, 26 of the second trough 14, thereby holding the second trough 14 within the first trough 12 while permitting extension of one of the first and second troughs relative to the other of the first and second troughs. In addition, as shown in FIG. 5, at least one of the first and second upright walls 24, 26 of the second trough may be downwardly bent as indicated by 31 in order to impart structural rigidity to the first and/or second upright walls 24, 26.

In certain embodiments, the length of the second trough 14 can be substantially the same length as the first trough 12, i.e., about 6, 7, 8, 9, or 10 feet, although it may be less. According to an embodiment of the subject disclosure, the height of the first and second upright walls 18, 20, 24, 26 of the first and second troughs 12, 14 may range from about 3¼ to about 4 inches, and the bottom walls 22, 28 of the first and second troughs 12, 14 may range from about 3⅜ to about 3¼ inches in width.

Figure 2:
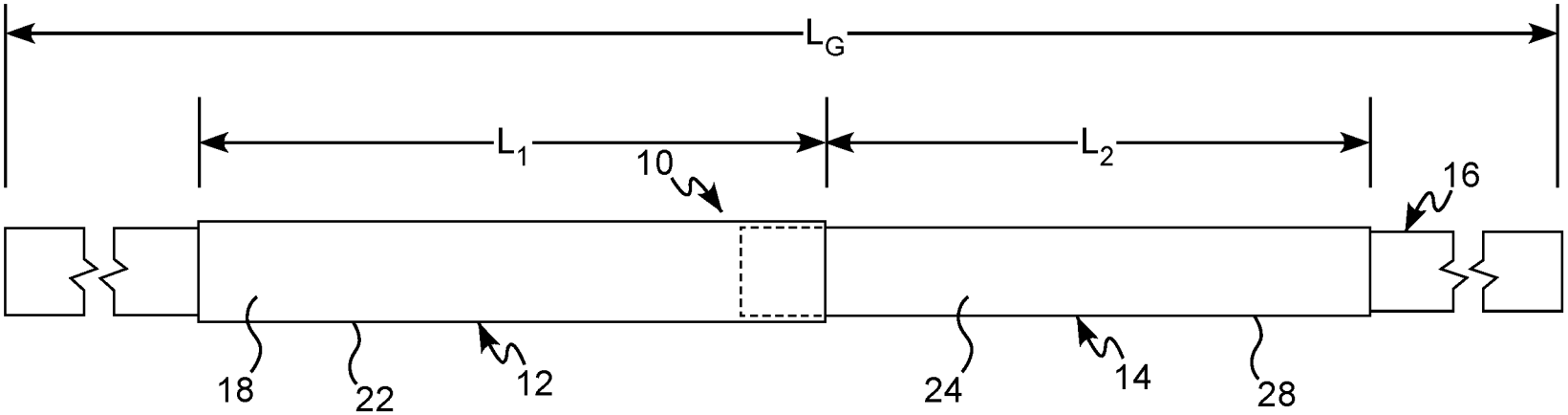
FIG. 2 is a side elevation view of the rain gutter installation device of FIG. 1 in expanded condition and supporting a rain gutter.

Referring to FIG. 2, device 10 is shown with the second trough 14 substantially fully extended from the first trough 12 at a length $L_2$. Together, length $L_1$ and length $L_2$ make up the working length of device 10 when in operation. It will be appreciated that the second trough 14 may be extended less than shown in FIG. 2 depending on the length of a gutter 16 to be carried by device 10. For example, device 10 can be used in installing gutters 16 having a length $L_G$ ranging from about 20 feet to about 60 feet in length. For shorter gutters having a length of about 20 to 30 feet, the working length of the device 10 may span a length from about 6, 7, 8, 9, or 10 feet. For longer gutters having a length of about 40 to 60 feet, the working length of the device 10 may span a length from about 10, 11, 12, 13, 14, 15, 16, 17, 18, 19 or 20 feet.

In an exemplary, but non-limitative embodiment, the first trough 12 can have a length of 8 feet ¾ inches and the second trough 14 can have a length of 8 feet 2¾ inches. If the second trough is extended 7 feet 1 inch, there exists an overlap between the first and second troughs of 13 inches whereby the total length of the device 10 is 15 feet 2 inches.

The trough assembly of device 10 may be fabricated from any suitable, substantially rigid to rigid, yet lightweight material including, without limitation, metal and/or plastic. According to an embodiment of the present disclosure, the first and second troughs 12, 14 of device 10 may be fabricated from 0.024 to 0.032 inch thick aluminum sheet bent into the shapes shown in the figures. In certain embodiments, device 10 may be relatively light in weight, as the installer must lift not only device 10, but also the gutter 16 supported therein when climbing a ladder to place the gutter at the desired installation position on a building. According to an embodiment of the present disclosure, the trough assembly may have an overall weight of about 6, 7, 8, 9, 10, 11, or 12 pounds. In exemplary embodiments, wherein the device 10 is fabricated from 0.027 inch thick aluminum sheet, an 8 foot long device 10, which is extendable to approximately 16 feet in length, weighs 6.03 pounds; a 9 foot long device 10, which is extendable to approximately 18 feet in length, weighs 6.70 pounds; and a 10 foot long device 10, which is extendable to approximately 20 feet in length, weighs 7.54 pounds.

Figure 4:
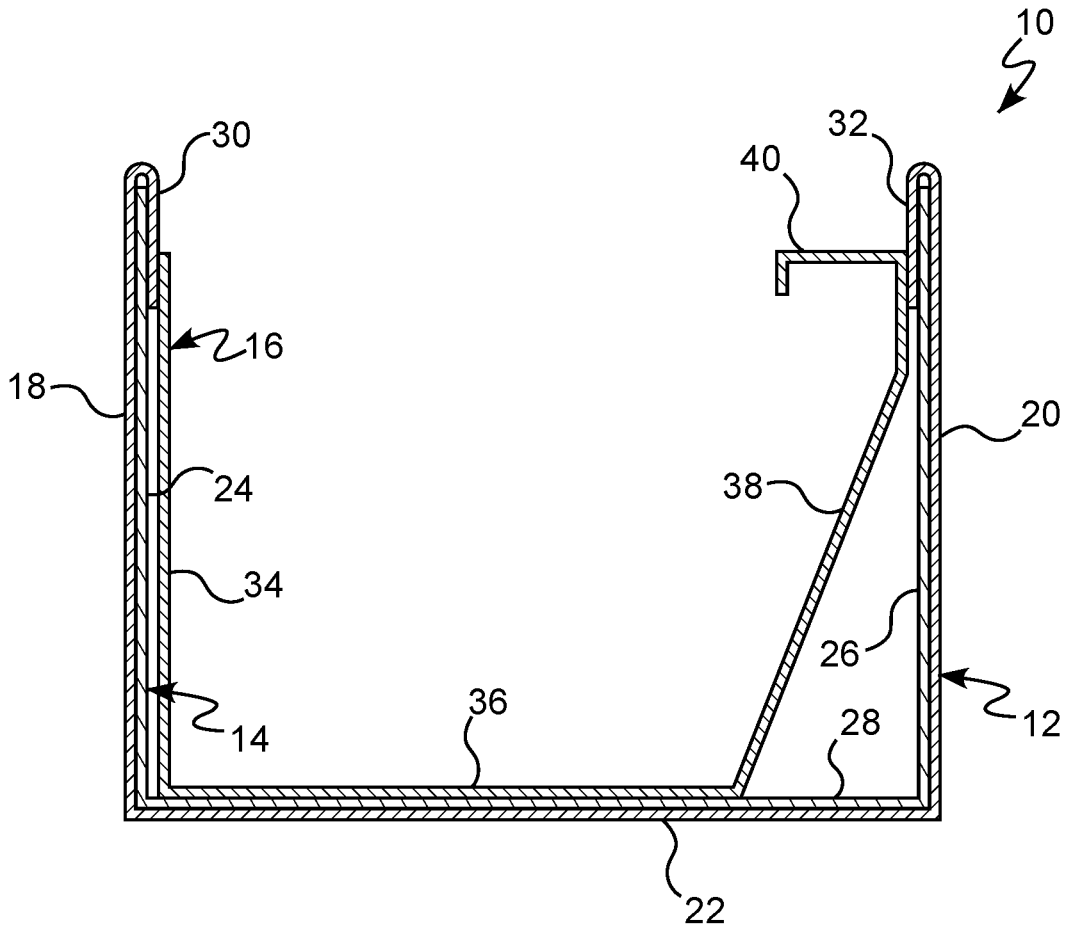
FIG. 4 is an end elevation view of the rain gutter installation device of FIG. 1 with a rain gutter supported therein.

Referring to FIG. 4, there is shown a gutter 16 resting in device 10. As is conventional, gutter 16 comprises an upright rear wall 34 which, along with unillustrated hangers that are installed in the gutter, serve to attach the gutter to a building. The gutter 16 further comprises a bottom wall 36, an upright and, typically, at least partially sloped front wall 38, and a rearwardly directed lip 40.

Figure 3A:
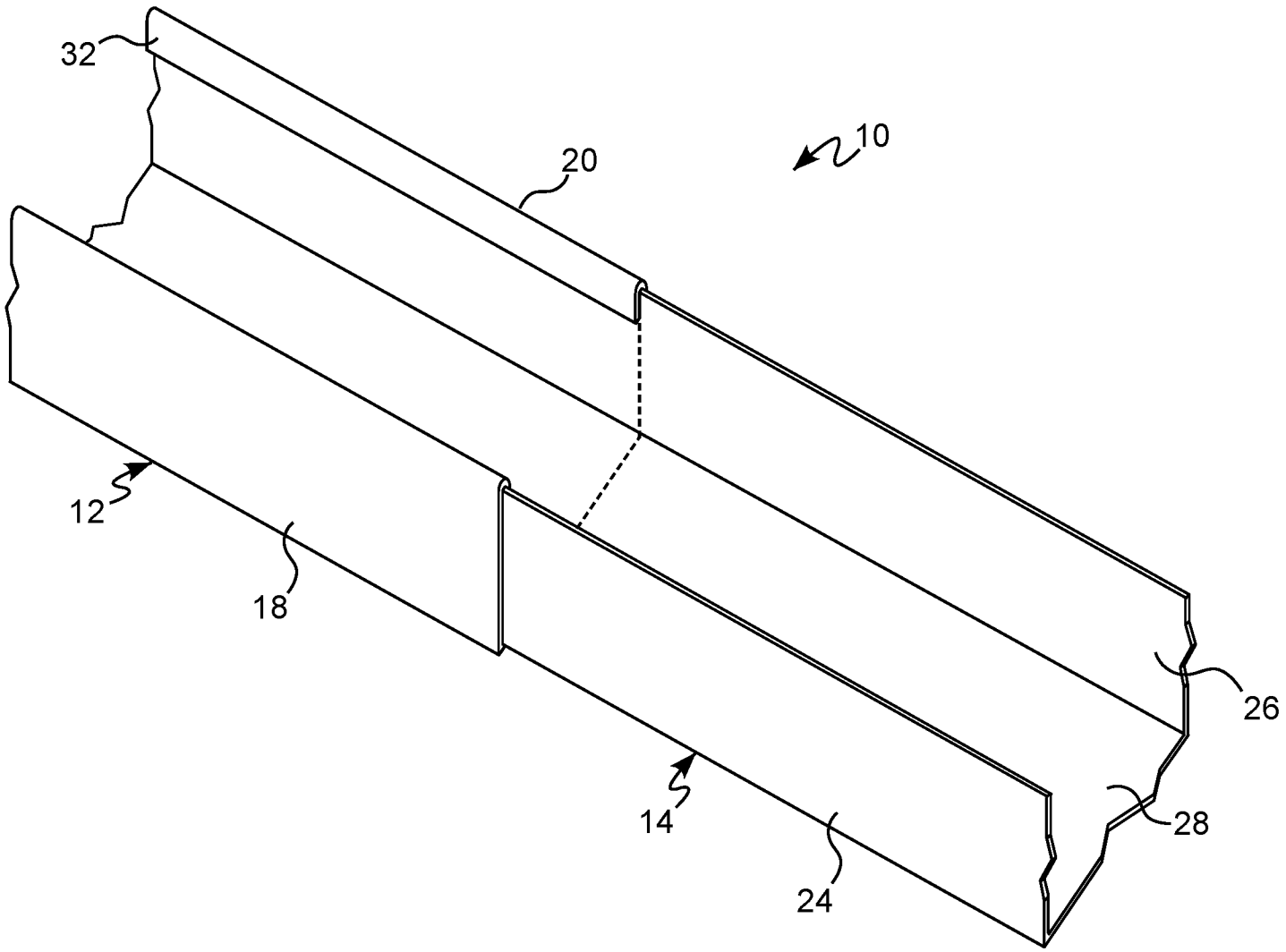
FIG. 3A is an enlarged perspective view of a portion of the rain gutter installation device of FIG. 1 with a second trough of the device extended from a first trough thereof.
Figure 3B:
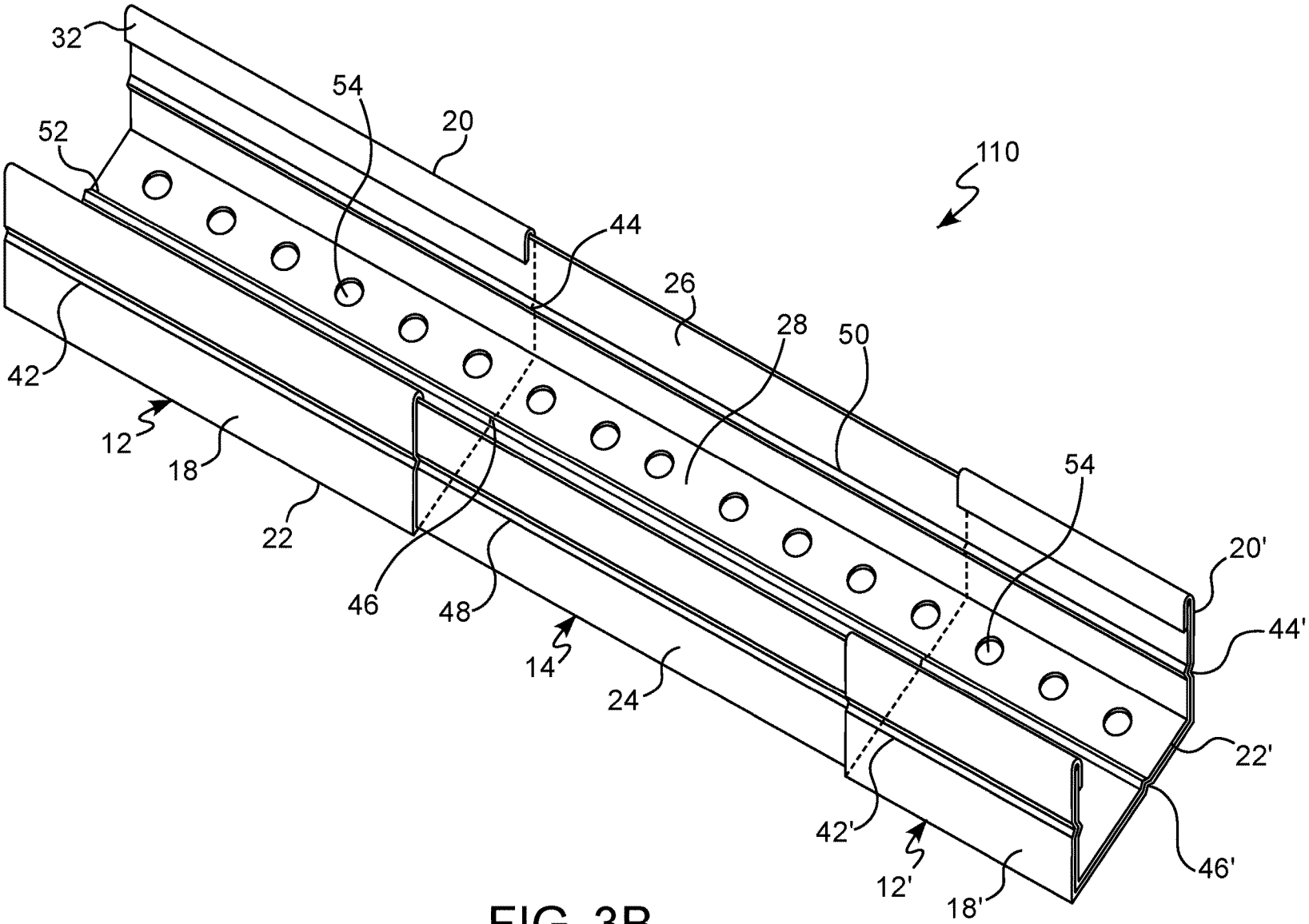
FIG. 3B is an enlarged perspective view of a portion of another embodiment of a rain gutter installation device according to the present disclosure with a second trough and a third trough of the device extended from a first trough thereof.

Referring to FIG. 3B, there is shown a further embodiment of a rain gutter installation device 100 according to the present disclosure which illustrates additional features which may be incorporated into the device. As shown in FIG. 3B, the trough assembly of device 100 includes a first trough 12, a second trough 14 and a third trough 12' engaged with and extendable from one of the first and second troughs. In the illustrated example, the third trough 12' is engaged with and extendable from the second trough 14 and extends in a direction opposite the first trough 12.

As also shown in FIG. 3B, the first trough 12 includes a first upright wall 18 having at least one rib 42. Likewise, the first trough includes an opposed second upright wall 20 having at least one rib 44. The first trough further includes a bottom wall 22 extending between the first and second upright walls, wherein the bottom wall includes at least one rib 46. Similarly, the second trough 14 includes a first upright wall 24 having at least one rib 48. The second trough further includes an opposed second upright wall 26 having at least one rib 50. Further, the second trough includes a bottom wall 28 extending between the first and second upright walls, wherein the bottom wall includes at least one rib 52. Additionally, the third trough 12' includes a first upright wall 18' having at least one rib 42'. Likewise, the third trough includes an opposed second upright wall 20' having at least one rib 44'. The third trough further includes a bottom wall 22' extending between the first and second upright walls, wherein the bottom wall includes at least one rib 46'.

The aforementioned ribs impart structural rigidity to the first, second and third troughs whereby the trough assembly resists twisting when the troughs thereof are extended relative to one another. The ribs can extend in a longitudinal direction of the troughs and nest within one another, as illustrated. Alternatively, the ribs can extend transversely to the longitudinal direction of the troughs. However, if transverse ribs are provided, they should be formed exteriorly of the first trough 12 (and third trough 12') and interiorly of the second trough 14 so that the ribs do not interfere with one another during extension and retraction of the trough assembly.

According to an aspect, at least one of the first and second troughs 12, 14 may include a plurality of apertures 54 to promote drainage of the trough assembly when a worker is using the rain gutter installation device on rainy days. As illustrated in FIG. 3B, apertures 54 are provided in bottom wall 20 of the second trough 14, although they could be provided in the first trough 12 or both the first and second troughs. Apertures 54 may be provided in the bottom walls of the trough(s) and/or at lower regions of the side walls thereof.

Another aspect of the present disclosure are methods of using the rain gutter installation device of the present invention to install gutters. When installing a gutter using device 10, the worker first measures the length of roof beneath which gutter 16 is to be installed. The worker then cuts the gutter 16 to the appropriate length, typically the roof length plus one inch. Thereafter, hangers are installed at spaced apart positions along the length of the gutter. Then, depending on the length of the gutter, the worker extends the second trough 14 of device 10 a desired distance $L_2$ from the first trough 12. This distance is selected so as to be sufficient to assure that the working length of the device stably supports the central region of the gutter and minimizes twisting of the ends of the gutter upon lifting of the device with the gutter contained therein. The worker then places the gutter in device 10 making sure that the device is substantially centered along the length of the gutter. The worker then places a ladder at substantially the center of the wall to which the gutter is to be attached. Thereafter, the worker lifts the device 10, with the gutter contained therein, from the bottom and climbs the ladder. Upon reaching the top of the wall, the worker supports the bottom center of the device 10 and secures a first generally centrally located gutter hanger to the wall. Then the worker moves the ladder to one end of the suspended gutter and anchors that end of the gutter to the wall and repeats the process at the opposite end of the gutter. Finally, the worker moves the ladder along the wall to secure the remaining gutter hangers to the wall.

It will be appreciated by those skilled in the art that changes could be made to the embodiments described above without departing from the broad inventive concept thereof. For example, device 10 may assume cross-sectional shapes other than a substantially U-shaped trough. That is, the cross-sectional shape of device 10 may be substantially semicircular or substantially trapezoidal, among others. It is to be understood, therefore, that this invention is not limited to the particular embodiment disclosed, but it is intended to cover modifications within the spirit and scope of the present invention as defined by the appended claims.

I claim:

1. A method of installing a rain gutter comprising:

providing a rain gutter installation device comprising:

a trough assembly having an opening sufficient to receive the rain gutter therein, the trough assembly including:

a first open-ended trough, and a second open-ended trough engaged with and extendable from the first open-ended trough;

inserting the rain gutter within the rain gutter installation device;

transporting the rain gutter installation device with the inserted rain gutter therein to a predetermined position; and removing the rain gutter from the rain gutter installation device.

2. A method of installing a rain gutter comprising:

obtaining a rain gutter installation device that includes:

a trough assembly having an opening to receive a rain gutter therein, the trough assembly including:

a first open-ended trough, and a second open-ended trough engaged with and extendable from the first open-ended trough;

inserting the rain gutter within the rain gutter installation device;

transporting the rain gutter installation device with the inserted rain gutter therein to a predetermined position; and removing the rain gutter from the rain gutter installation device.

3. A method of transporting a rain gutter comprising inserting a rain gutter within a rain gutter installation device that includes:

a trough assembly having an opening to receive a rain gutter therein, the trough assembly including:

a first open-ended trough, and a second open-ended trough extendable from the first open-ended trough;

transporting the rain gutter installation device with the inserted rain gutter therein to a predetermined position; and removing the rain gutter from the rain gutter installation device.

* * * * *